US010816255B2

(12) United States Patent
Song et al.

(10) Patent No.: US 10,816,255 B2
(45) Date of Patent: Oct. 27, 2020

(54) REFRIGERATOR

(71) Applicant: SAMSUNG ELECTRONICS CO., LTD., Suwon-si, Gyeonggi-do (KR)

(72) Inventors: Young Il Song, Hwaseong-si (KR); Jae Koog An, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/454,071

(22) Filed: Mar. 9, 2017

(65) Prior Publication Data

US 2017/0261247 A1 Sep. 14, 2017

(30) Foreign Application Priority Data

Mar. 10, 2016 (KR) ..... 10-2016-0029118

(51) Int. Cl.
*F25C 5/182* (2018.01)
*F25C 5/20* (2018.01)

(52) U.S. Cl.
CPC ..... *F25C 5/182* (2013.01); *F25C 5/22* (2018.01); *F25C 2400/04* (2013.01); *F25C 2400/10* (2013.01); *F25C 2500/02* (2013.01)

(58) Field of Classification Search
CPC ..... F25C 5/005; F25C 5/182; F25C 5/007; F25C 2400/10; F25C 2500/02; F25C 2400/04; F25C 5/22
USPC ..... 62/344, 320
See application file for complete search history.

(56) References Cited

U.S. PATENT DOCUMENTS 6,082,130 A 7/2000 Pastryk et al.
8,479,533 B2 * 7/2013 Chase ..... F25C 5/24 62/344
9,285,149 B2 * 3/2016 Bamberger ..... F25C 5/20
2004/0237569 A1 * 12/2004 Lee ..... F25C 5/046 62/353
2005/0178145 A1 * 8/2005 Lee ..... F25D 17/065 62/441
2009/0008403 A1 * 1/2009 Lee ..... G07F 9/02 221/89

(Continued)

FOREIGN PATENT DOCUMENTS

CN 101140129 3/2008
CN 103196270 7/2013

(Continued)

OTHER PUBLICATIONS

Chinese Office Action dated Mar. 15, 2019 in Chinese Patent Application No. 201710140504.7.

(Continued)

*Primary Examiner* — David J Teitelbaum
(74) *Attorney, Agent, or Firm* — Staas & Halsey LLP

(57) ABSTRACT

Disclosed herein is a refrigerator having an ice bucket with a simple structure. The refrigerator may include a main body and an ice bucket provided to supply ice, wherein the ice bucket includes an ice bank provided with an ice storage space therein and an opening, an auger rotatably disposed in the ice bank to rotate about a rotating shaft to transfer ice, and a guide lever rotatably installed in the ice bank to open or close the opening and configured to open the opening by being pushed by ice being transferred in a direction of the rotating shaft.

11 Claims, 9 Drawing Sheets

(56) References Cited

U.S. PATENT DOCUMENTS

| | | | | |
|---|---|---|---|---|
| 2009/0165492 | A1* | 7/2009 | Wilson | F25C 1/10 62/344 |
| 2009/0293508 | A1* | 12/2009 | Rafalovich | F25C 5/005 62/66 |
| 2010/0281906 | A1 | 11/2010 | Chung et al. | |
| 2013/0067947 | A1* | 3/2013 | Son | F25C 5/005 62/379 |
| 2013/0174596 | A1* | 7/2013 | Kim | F25C 1/04 62/320 |
| 2013/0174599 | A1* | 7/2013 | Jeong | F25C 5/182 62/344 |
| 2013/0327081 | A1* | 12/2013 | Son | F25C 5/002 62/344 |
| 2014/0013792 | A1* | 1/2014 | Lee | F25C 1/00 62/344 |
| 2014/0290300 | A1* | 10/2014 | Jeong | F25C 5/007 62/344 |
| 2014/0345313 | A1* | 11/2014 | Jeong | F25C 5/005 62/320 |

FOREIGN PATENT DOCUMENTS

| | | |
|---|---|---|
| CN | 103542662 | 1/2014 |
| CN | 104272044 | 1/2015 |
| DE | 102008019143 A1 | 5/2009 |
| KR | 10-2005-0028225 | 3/2005 |
| WO | 2009/072826 | 6/2009 |
| WO | 2013/169732 | 11/2013 |
| WO | WO 2013/169732 A1 | 11/2013 |

OTHER PUBLICATIONS

European Communication dated Jul. 12, 2019 in European Patent Application No. 17159340.3.

Chinese Office Action dated Oct. 24, 2019 in Chinese Patent Application No. 201710140504.7.

Chinese Office Action dated Mar. 30, 2020 in Chinese Patent Application No. 201710140504.7.

Extended European Search Report dated Jun. 21, 2017 in related European Patent Application No. 17159340.3.

* cited by examiner

REFRIGERATOR

CROSS-REFERENCE TO RELATED APPLICATION

This application claims the benefit of Korean Patent Application No. 10-2016-0029118, filed on Mar. 10, 2016 in the Korean Intellectual Property Office, the disclosure of which is incorporated herein by reference.

BACKGROUND

1. Field

Embodiments of the present disclosure relate to a refrigerator, and more particularly, to a refrigerator having an ice bucket with a simplified structure.

2. Description of the Related Art

Generally, a refrigerator is a device configured to supply cold air having a low temperature to a storage compartment in which food is stored to store the food to be fresh at a low temperature and includes a freezer compartment in which a freezing temperature or less is maintained and a refrigerator compartment in which a temperature slightly above the freezing temperature is maintained.

Recently, various large refrigerators have been launched in accordance with convenience in daily life and the necessity for storage space, and the large refrigerators can be classified into a general type, a double-door type, and a combined type according to a structure in which a refrigerator compartment and a freezer compartment are disposed and doors are installed.

In addition, the door of the refrigerator includes a dispenser so that a user can be supplied with ice or water from the outside, and an ice-making device is provided in the storage compartment to supply ice to the dispenser.

The ice-making device includes an ice-making tray configured to generate ice and an ice bank configured to store the ice generated by the ice-making tray, and the ice generated by the ice-making tray is separated from the ice-making tray by an ice-ejecting device and stored in the ice bank.

In addition, the ice-making device may also further include an ice-grinding device including a fixed cutter and a rotating cutter so that a user can receive ice which is ground as well as ice which is not ground and an exit opening and closing device configured to open or close an exit of the ice bank so that large ice which is not ground is discharged or small ice which is ground is discharged according to an extent of opening of the exit of the ice bank. In this case, since the exit opening and closing device may be manufactured as a complex structure including an opening and closing member, a connecting rod, a solenoid driving device, and the like, there is a drawback in that it is difficult to manufacture the exit opening and closing device. In addition, since a driving source configured to drive the opening and closing member of the exit opening and closing device is provided with a solenoid driving device configured to receive power and perform a linear reciprocating motion, there is a problem in that noise is generated whenever the solenoid driving device is operated to operate the opening and closing member.

SUMMARY

Therefore, it is an aspect of the present disclosure to provide a refrigerator having an improved structure with a simple configuration capable of opening or closing an opening of an ice bank.

It is another aspect of the present disclosure to provide a refrigerator having an improved structure capable of opening or closing an opening of an ice bank without using a separate electric driving source.

It is still another aspect of the present disclosure to provide a refrigerator having an improved structure capable of reducing noise generated during an operation of opening of an ice bank is opened or closed.

Additional aspects of the disclosure will be set forth in part in the description which follows and, in part, will be obvious from the description, or may be learned by practice of the disclosure.

In accordance with one aspect of the present disclosure, a refrigerator includes a main body, and an ice bucket provided to supply ice, wherein the ice bucket includes an ice bank provided with an ice storage space therein and an opening, an auger rotatably disposed in the ice bank to rotate about a rotating shaft to transfer ice, and a guide lever rotatably installed in the ice bank to open or close the opening and configured to open the opening by being pushed by ice being transferred in a rotating shaft direction of the auger.

The guide lever may be fixed to the ice bank to be positioned above the opening, and is configured to rotate about a guide lever shaft configured to extend in a different direction than the rotating shaft of the auger The rotating shaft of the auger may be perpendicular to the guide lever shaft.

The guide lever may open or close a part of the opening.

The guide lever may include a guide lever shaft fixed to the ice bank to be positioned above the opening, and a body configured to extend from the guide lever shaft and open or close the opening without interfering with the rotating shaft of the auger when the guide lever is rotated.

The body may surround at least a part of the rotating shaft of the auger and is spaced apart from the rotating shaft of the auger.

The ice bucket may further include an ice moving path provided to move ice and including the ice storage space and an ice discharging space disposed adjacent to the ice storage space.

The ice storage space and the ice discharging space may be disposed in the rotating shaft direction of the auger, and the guide lever may be accommodated in the ice discharging space and rotatably installed at the ice bank.

The rotating shaft of the auger may pass through the opening so that a part of the rotating shaft of the auger protrudes into the ice discharging space.

The ice bucket may further include an ice bank cover provided with the ice discharging space therein and a discharge hole through which ice that passes through the opening is discharged to an outside of the ice bucket.

The ice bucket may further include a guide lever cover disposed between the ice bank and the ice bank cover, configured to define the ice discharging space, and including an opening hole corresponding to the discharge hole.

The rotating shaft of the auger may pass through the opening so that one end of the rotating shaft of the auger protrudes into the ice discharging space, and the one end of the rotating shaft of the auger configured to protrude into the ice discharging space may be coupled to the guide lever cover.

The guide lever may rotate toward an inside of the ice discharging space until the guide lever cover interferes with the guide lever.

The guide lever cover and the ice bank cover may be integrally formed.

The ice bucket may further include an elastic member configured to apply an elastic force to rotate the guide lever so that the guide lever closes the opening when the auger is stationary.

In accordance with another aspect of the present disclosure, a refrigerator includes a main body, and an ice bucket provided to supply ice, wherein the ice bucket includes, an ice bank provided with an ice storage space therein and an opening, an auger rotatably disposed in the ice bank to rotate about a rotating shaft to transfer ice, an ice moving path provided to move ice and including the ice storage space and an ice discharging space disposed in a direction of a rotating shaft of the auger with the ice storage space, and a guide lever rotatably installed at the ice bank to open or close the opening and configured to open the opening by being pushed by ice transferred according to rotation of the auger.

The guide lever may be fixed to the ice bank to be positioned above the opening and rotates about a guide lever shaft configured to extend in a different direction than the rotating shaft of the auger.

The ice bucket may further include an ice bank cover coupled to the ice bank and including a discharge hole through which ice that passes through the opening is discharged to an outside of the ice bucket.

The ice bucket may further include an elastic member configured to apply an elastic force to rotate the guide lever so that the guide lever closes the opening when the auger is stationary.

The elastic member may include a torsion spring.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, an exemplary embodiment of the present disclosure will be described in detail. Meanwhile, the terms used in the specification, such as "front end," "back end," "upper portion," "lower portion," "upper end," and "lower end" are defined on the basis of the drawings, and shapes and positions of components are not limited to the terms.

Hereinafter, the term "I" denoted in FIGS. 5B, 7A, and 7B refers to ice.

Figure 1:
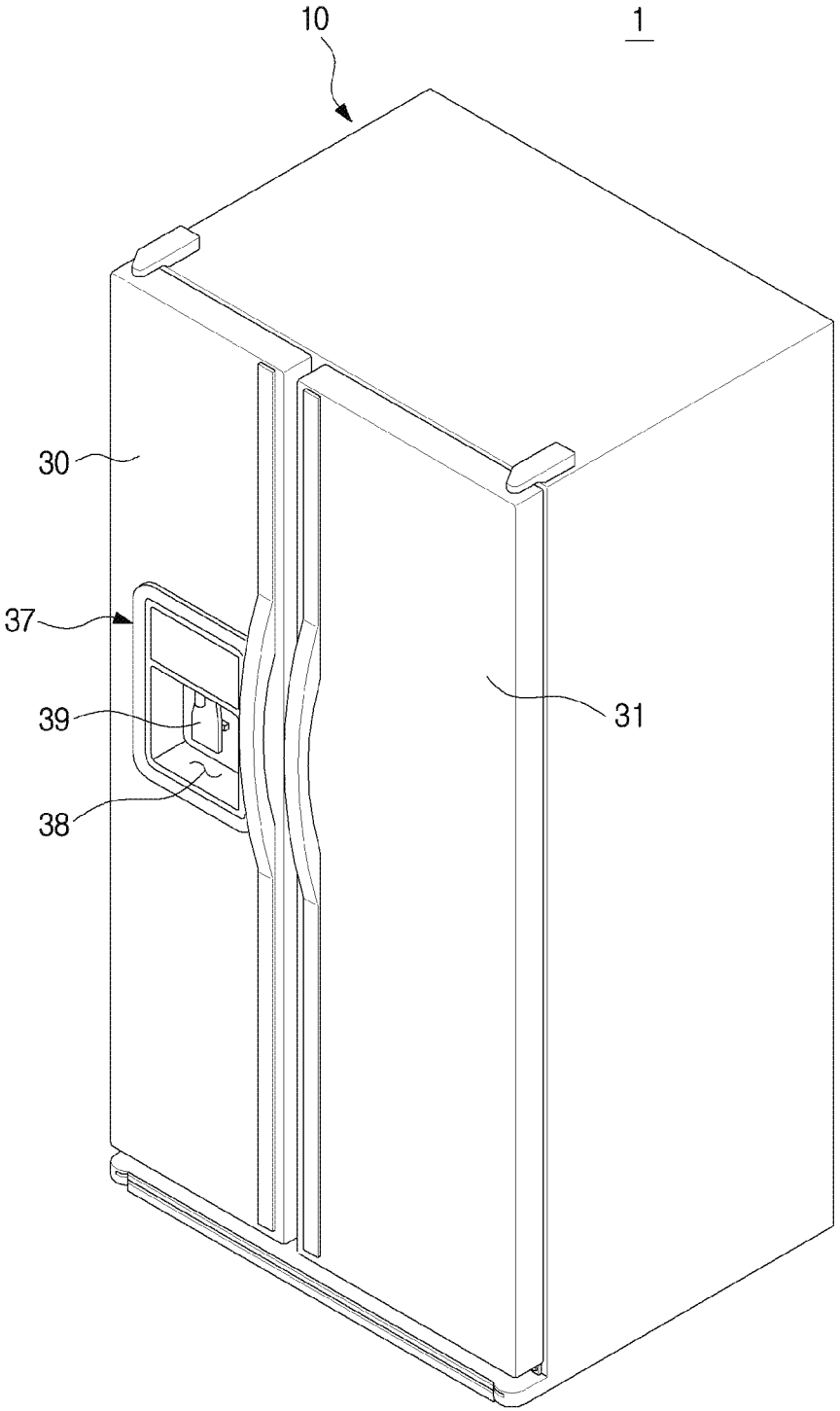
FIG. 1 is a perspective view illustrating an exterior of a refrigerator according to one embodiment of the present disclosure.
Figure 2:
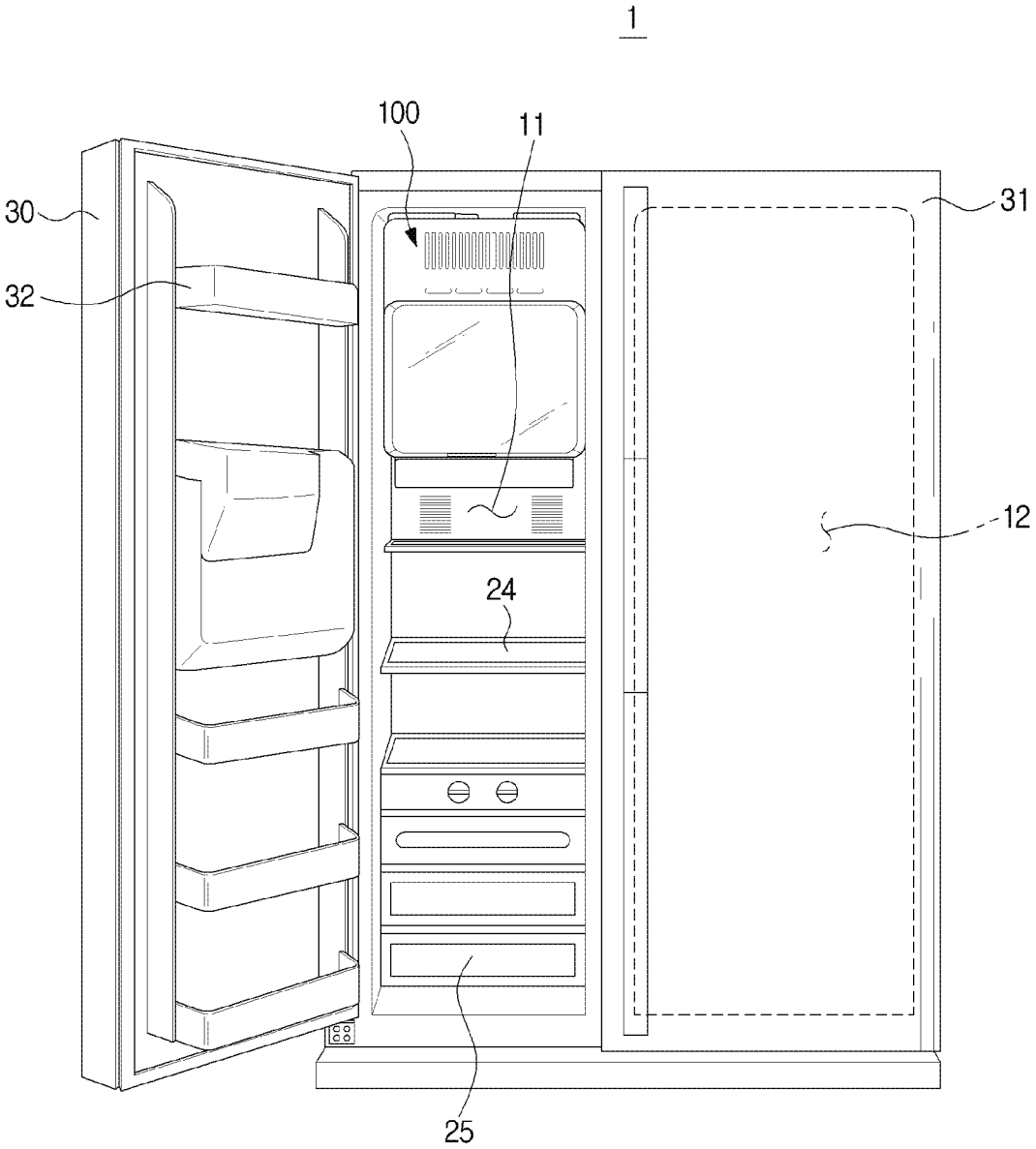
FIG. 2 is a view illustrating an open state of a freezer compartment door of the refrigerator according to one embodiment of the present disclosure.
Figure 3:
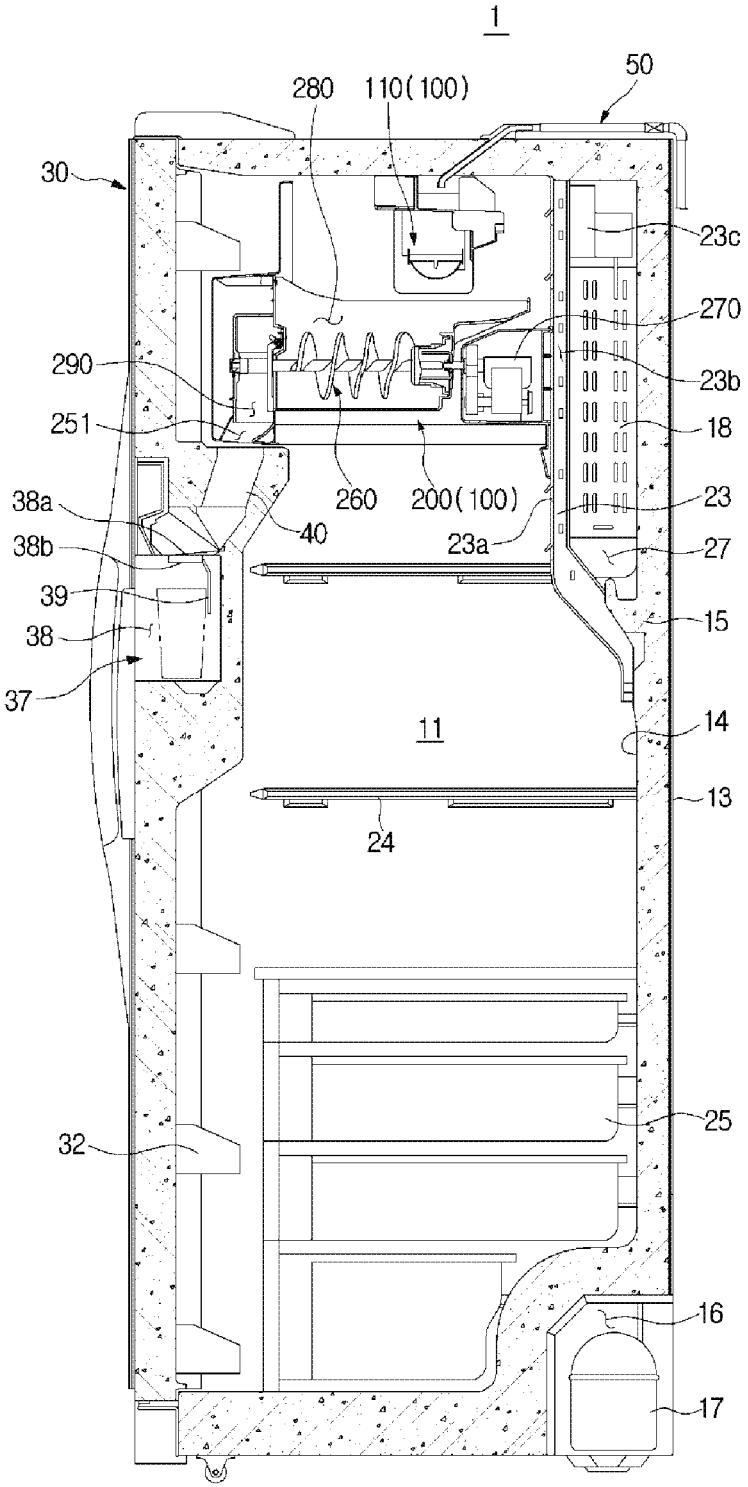
FIG. 3 is a cross-sectional view illustrating the refrigerator according to one embodiment of the present disclosure taken along line A-A' of FIG. 1.

FIG. 1 is a perspective view illustrating an exterior of a refrigerator according to one embodiment of the present disclosure, and FIG. 2 is a view illustrating an open state of a freezer compartment door of the refrigerator according to one embodiment of the present disclosure. FIG. 3 is a cross-sectional view illustrating the refrigerator according to one embodiment of the present disclosure taken along line A-A' of FIG. 1.

As illustrated in FIGS. 1 to 3, a refrigerator 1 may include a main body 10. The main body 10 may include an inner case 14 configured to form storage compartments 11 and 12, an outer case 13 coupled to an outside of the inner case 14 to form an exterior of the refrigerator 1, and an insulating member 15 foamed between the inner case 14 and the outer case 13.

The refrigerator 1 may further include the storage compartments 11 and 12 formed in the main body 10 to store food. Specifically, the storage compartments 11 and 12 may be formed in the inner case 14.

The refrigerator 1 may further include a cold air supply device configured to supply cold air to the storage compartments 11 and 12 to store food stored in the storage compartments 11 and 12 to be fresh. The cold air supply device may include a compressor 17 configured to compress a refrigerant to a high pressure, a condenser (not shown) configured to condense the compressed refrigerant, an expansion device (not shown) configured to expand the refrigerant to a low pressure, an evaporator 18 configured to evaporate the refrigerant to generate cold air, and a refrigerant pipe (not shown) configured to guide the refrigerant.

The compressor 17 and the condenser (not shown) may be disposed in a machine compartment 16 disposed at a lower portion behind the main body 10. An inner panel 23 is installed behind the storage compartments 11 and 12 to partition a cold air supply duct 27 configured to generate cold air supplied to the storage compartments 11 and 12, and the evaporator 18 may be disposed in the cold air supply duct 27.

A plurality of discharge holes 23*a* spaced a predetermined distance from each other to evenly disperse and discharge cold air into the storage compartments 11 and 12 and a cold air path 23*b* configured to guide the cold air to the plurality of discharge holes 23*a* may be formed in the inner panel 23. In addition, a blower fan 23*c* configured to blow cold air which passed through the evaporator 18 and exchanged heat therewith to the cold air path 23*b* and the plurality of discharge holes 23*a* may be installed at the inner panel 23.

The storage compartments 11 and 12 may be divided into the storage compartment 11 at a left side and the storage compartment 12 at a right side by a partition (not shown). The left storage compartment 11 may be used as a freezer compartment configured to keep food frozen, and the right storage compartment 12 may be used as a refrigerator compartment configured to keep food refrigerated. The partition (not shown) may include an insulating member to prevent a heat exchange between the left storage compartment 11 and the right storage compartment 12.

Fronts of the storage compartments 11 and 12 may be provided to be open to store or withdraw food therein or therefrom.

At least one shelf 24 may be disposed in the storage compartments 11 and 12 to put food thereon. Spaces in the storage compartments 11 and 12 may be each divided into a lower portion and an upper portion by the at least one shelf 24. In addition, at least one basket 25 may be disposed in the storage compartments 11 and 12 to store food.

The refrigerator 1 may further include doors 30 and 31 rotatably installed at the main body 10 to open or close the open fronts of the storage compartments 11 and 12. Specifically, the doors 30 and 31 may be rotatably hinge-coupled to the main body 10. The doors 30 and 31 may include a left door 30 configured to open or close the left storage compartment 11 and a right door 31 configured to open or close the right storage compartment 12.

A plurality of door shelves 32 may be installed on inner surfaces of the left door 30 and the right door 31 to store food.

The refrigerator 1 may further include an ice-making device 100 configured to generate ice. The ice-making device 100 may be provided at one side of the storage compartment 11 or 12. For example, the ice-making device 100 may be provided at the left storage compartment 11 configured to be used as a freezer compartment. The ice-making device 100 may also be provided at the door 30 or 31 as well as the storage compartment 11 or 12.

The ice-making device 100 may include an ice-making tray 110 configured to cool supplied water and generate ice.

The ice-making device 100 may further include a water supply device 50 provided to supply water to the ice-making tray 110.

The ice-making device 100 may further include an ejector (not shown) configured to separate ice from the ice-making tray 110, an ice-ejecting motor (not shown) configured to rotate the ejector, an ice-ejecting heater (not shown) configured to heat the ice-making tray 110 to ease separation of ice from the ice-making tray 110 when the ice is separated therefrom, and the like.

The ice-making device 100 may further include an ice bucket 200 provided to supply the ice generated by the ice-making tray 110. The ice bucket 200 may be disposed at a lower portion of the ice-making tray 110 so that the ice separated from the ice-making tray 110 is supplied thereto.

The ice bucket 200 may include an ice bank 210 provided to store the ice generated by the ice-making tray 110. The ice bank 210 may be disposed at the lower portion of the ice-making tray 110 to collect the ice that falls from the ice-making tray 110.

The ice bucket 200 may further include an auger 260 configured to transfer the ice stored in the ice bank 210 to a discharge hole 251.

The ice bucket 200 may further include an auger motor 270 configured to drive the auger 260. The auger motor 270 may be disposed behind the ice bank 210.

The refrigerator 1 may further include a dispenser 37 provided so that water or ice may be withdrawn from the outside even when the doors 30 and 31 are not open. The dispenser 37 may be provided at the door 30 or 31. For example, the dispenser 37 may be provided at the left door 30.

The dispenser 37 may include a withdraw port 38 having a space that recessed inward from the front of the left door 30 and includes a withdraw hole 38*a* configured to withdraw ice so that an operation for withdrawing the ice is performed, an opening and closing member 38*b* configured to open or close the withdraw hole 38*a*, an operating lever 39 installed at the withdraw port 38 to drive the opening and closing member 38*b* while operating the ice-making device 100 provided in the storage compartment 11 or 12, and a chute 40 configured to guide ice in the ice-making device 100 to the withdraw hole 38*a*.

Hereinafter, the ice bucket 200 will be described.

Figure 4:
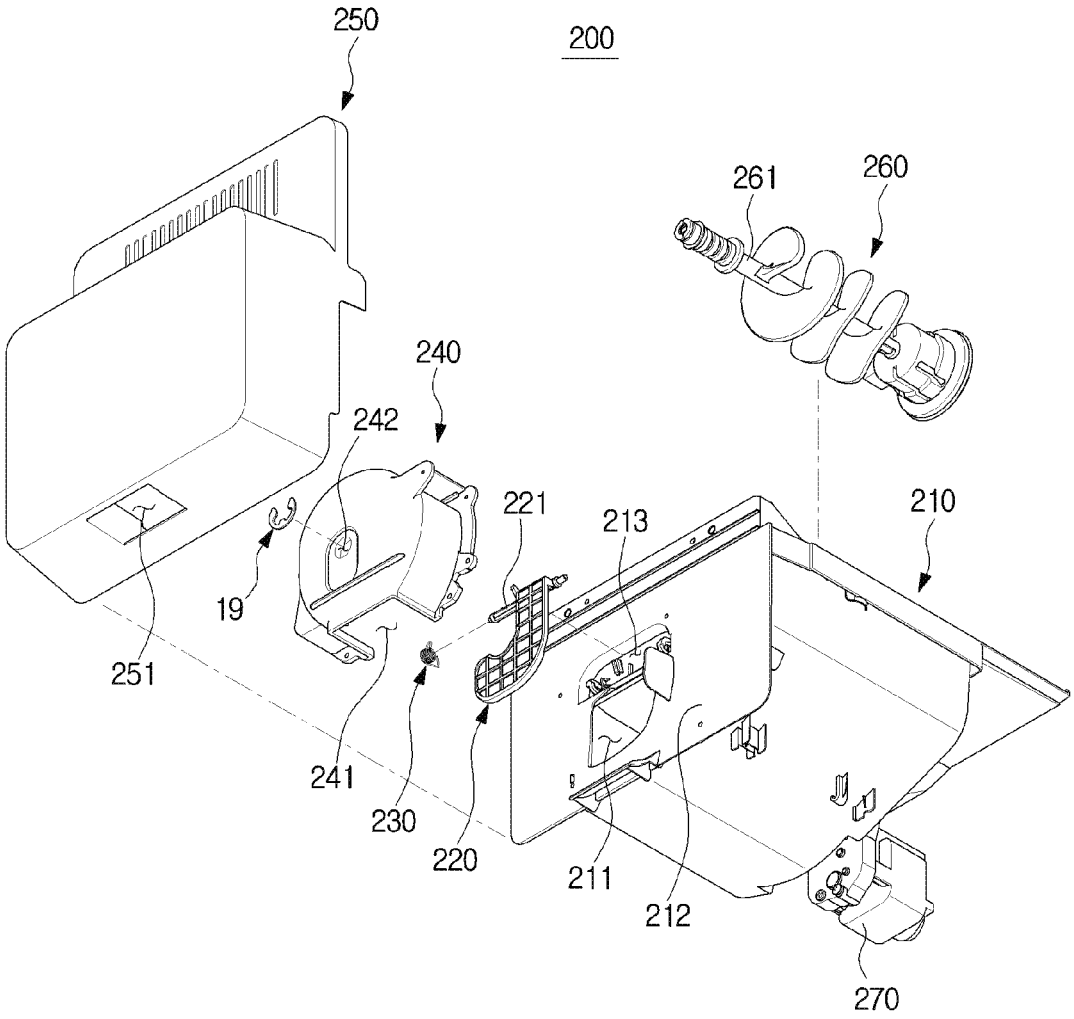
FIG. 4 is an exploded perspective view illustrating an ice bucket of the refrigerator according to one embodiment of the present disclosure.
Figure 5A:
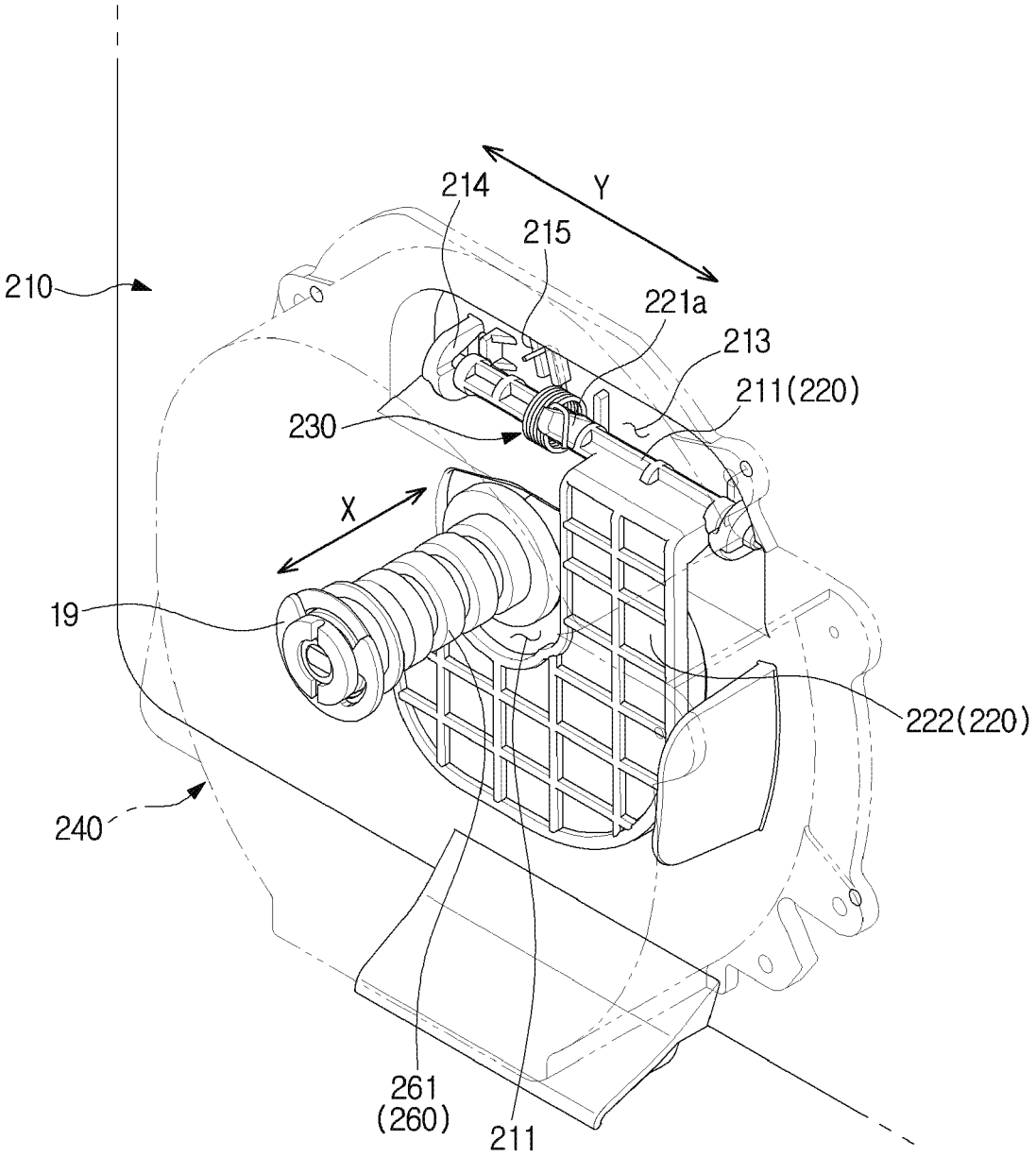
FIG. 5A is an enlarged view illustrating a guide lever structure of the refrigerator according to one embodiment of the present disclosure when an opening of the ice bucket is closed.

FIG. 4 is an exploded perspective view illustrating an ice bucket of the refrigerator according to one embodiment of the present disclosure, and FIG. 5A is an enlarged view illustrating a guide lever structure of the refrigerator according to one embodiment of the present disclosure when an opening of the ice bucket is closed. FIG. 5B is an enlarged view illustrating the guide lever structure of the refrigerator according to one embodiment of the present disclosure when the opening of the ice bucket is open. Hereinafter, reference numerals which are not shown refer to FIGS. 1 to 3.

Figure 5B:
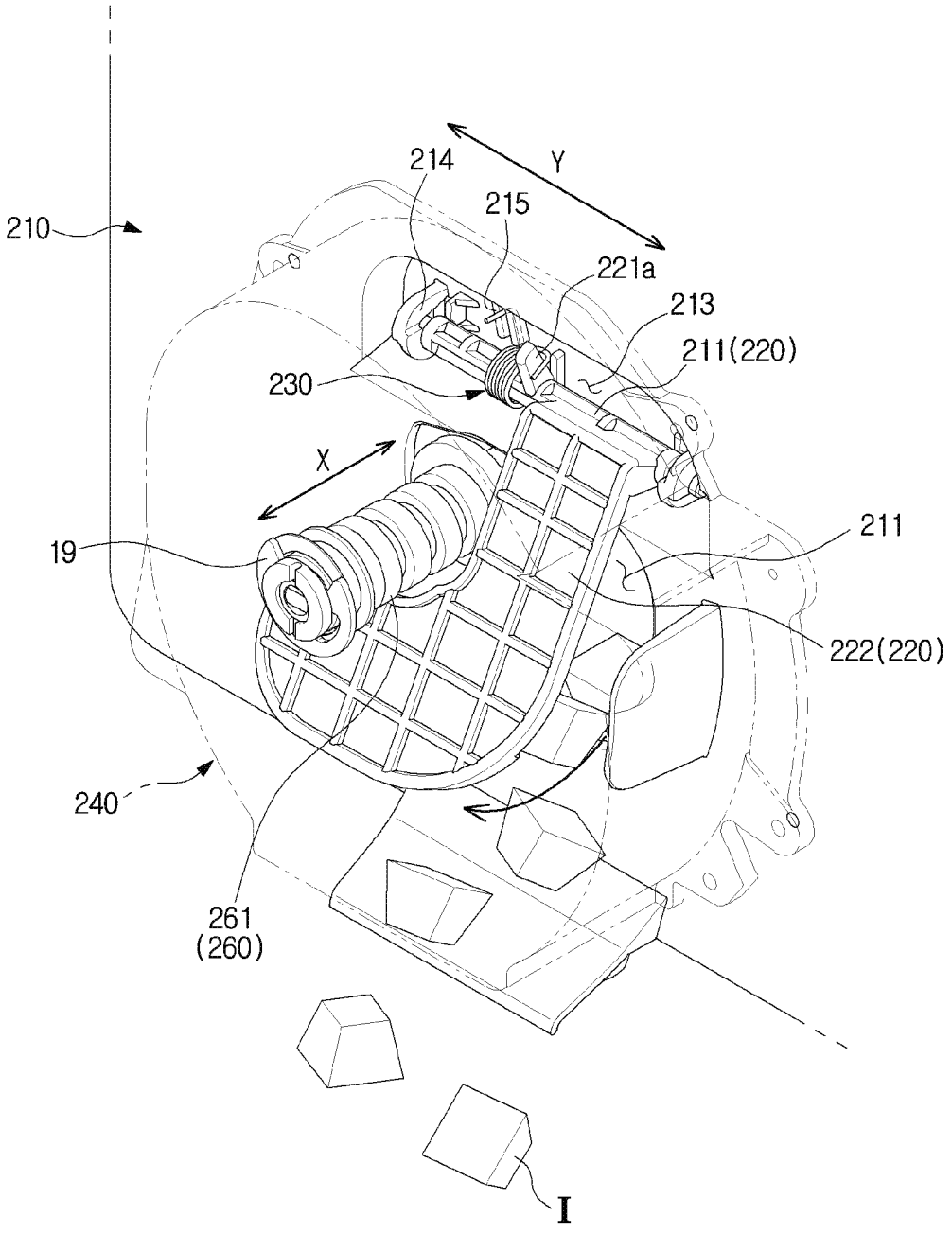
FIG. 5B is an enlarged view illustrating the guide lever structure of the refrigerator according to one embodiment of the present disclosure when the opening of the ice bucket is open.

As illustrated in FIGS. 4 to 5B, the ice bucket 200 may include the ice bank 210. The ice bank 210 may have a box shape having one open side facing the ice-making tray 110. An ice storage space 280 configured to store ice may be provided in the ice bank 210. An opening 211 may be formed in the ice bank 210. In other words, the ice bank 210 may include an opening forming wall 212 configured to form the opening 211. A lever shaft seating portion 213 may be formed in the ice bank 210. The lever shaft seating portion 213 may be formed to be recessed from the opening forming wall 212 and located above the opening 211. Lever shaft couplers 214 to which both ends of a guide lever shaft 221 are coupled may be provided at the lever shaft seating portion 213. The lever shaft couplers 214 may be formed to protrude from the lever shaft seating portion 213 so that both of the ends of the guide lever shaft 221 are hinge-coupled thereto. An elastic member fixture 215 configured to fix one end of an elastic member 230, which will be described below, may be formed at the lever shaft seating portion 213. The elastic member fixture 215 may be formed at the lever shaft seating portion 213 and located between the lever shaft couplers 214.

The ice bucket 200 may include the auger 260 disposed in the ice bank 210 to be rotatable about the rotating shaft 261 to transfer ice. The auger 260 may be driven by the auger motor 270 disposed behind the ice bank 210. The auger 260 may rotate in one direction. As the auger 260 rotates, ice stored in the ice bank 210 is moved toward the opening 211.

The rotating shaft 261 of the auger 260 may pass through the opening 211 so that one part of the rotating shaft 261 of the auger 260 protrudes toward the outside of the ice storage space 280. In other words, one end of the rotating shaft 261 of the auger 260 may pass through the opening 211 and protrude toward the outside of the ice storage space 280, and the other end of the rotating shaft 261 of the auger 260 may be coupled to the auger motor 270 disposed behind the ice bank 210.

The ice bucket 200 may further include a guide lever 220. The guide lever 220 serves to prevent ice from falling through the discharge hole 251 due to an impact when the doors 30 and 31 are opened or closed. The guide lever 220 may be rotatably installed in the ice bank 210 to open or close the opening 211. The guide lever 220 may open the opening 211 by being pushed by ice transferred in a rotating shaft direction X of the auger 260 (see FIG. 5A).

The guide lever 220 may be fixed to the ice bank 210 and located above the opening 211. The guide lever 220 may rotate about the guide lever shaft 221 configured to extend in a different direction than the rotating shaft 261 of the auger 260. The rotating shaft 261 of the auger 260 may be perpendicular to the guide lever shaft 221. In the drawings, a direction of the guide lever shaft that the guide lever shaft 221 extends along is denoted as "Y."

The guide lever 220 may open or close a part of the opening 211. The opening 211 may be described as including a first portion through which the rotating shaft 261 of the auger 260 passes and a second portion opened or closed by the guide lever 220 in another aspect.

The guide lever 220 may include the guide lever shaft 221. The guide lever shaft 221 may be fixed to the ice bank 210 and located above the opening 211. Specifically, the guide lever shaft 221 may be fixed to the lever shaft coupler 214 formed at the lever shaft seating portion 213.

The guide lever 220 may further include a body 222. The body 222 may extend from the guide lever shaft 221 and open or close the opening 211 without interfering with the rotating shaft 261 of the auger 260 when the guide lever 220 rotates. The body 222 may surround at least a part of the rotating shaft 261 of the auger 260 and be spaced apart from the rotating shaft 261 of the auger 260.

The ice bucket 200 may further include ice moving paths 280 and 290 through which ice is moved. The guide lever 220 may open or close the opening 211 disposed on the ice moving paths 280 and 290.

The ice moving paths 280 and 290 may include an ice storage space 280 and an ice discharging space 290 disposed to be adjacent to the ice storage space 280. The ice storage space 280 and the ice discharging space 290 may be disposed in the rotating shaft direction X of the auger 260. Specifically, the ice storage space 280 may be disposed at a rear portion in the rotating shaft direction X of the auger 260, and the ice discharging space 290 may be disposed at a front portion in the rotating shaft direction X of the auger 260. The guide lever 220 may be accommodated in the ice discharging space 290 and rotatably installed in the ice bank 210.

The ice bucket 200 may further include the elastic member 230. The elastic member 230 may apply an elastic force to rotate the guide lever 220 so that the guide lever 220 closes the opening 211 when the auger 260 is stationary. The elastic member 230 may include a torsion spring.

One end of the elastic member 230 may be fixed to the ice bank 210, and the other end of the elastic member 230 may be fixed to the guide lever 220. Specifically, the one end of the elastic member 230 may be inserted and coupled to the elastic member fixture 215 of the ice bank 210. The other end of the elastic member 230 may be hooked and coupled to a locking protrusion 221*a* formed to protrude from the guide lever shaft 221. Here, the elastic member 230 may be in a state in which the elastic member 230 is wound around the guide lever shaft 221. However, an arrangement structure of the elastic member 230 is not limited thereto and may be variously modified.

When the auger 260 is stationary, the guide lever 220 normally closes the opening 211 due to an elastic force of the elastic member 230.

The ice bucket 200 may further include an ice bank cover 250. The ice discharging space 290 may be provided in the ice bank cover 250. In addition, the discharge hole 251 through which ice which passed through the opening 211 is discharged to the outside of the ice bucket 200 may be formed in the ice bank cover 250. The ice bank cover 250 may be fixedly coupled to the ice bank 210 by a fixing member (not shown). Specifically, the ice bank cover 250 may be fixedly coupled to the opening forming wall 212 of the ice bank 210 by the fixing member. The fixing member may include a screw and the like, but as long as the fixing member couples the ice bank cover 250 to the ice bank 210, a kind thereof is not limited.

The ice bucket 200 may further include a guide lever cover 240 interposed between the ice bank 210 and the ice bank cover 250 and configured to define the ice discharging space 290. An opening hole 241 corresponding to the discharge hole 251 may be formed in the guide lever cover 240.

One end of the rotating shaft 261 of the auger 260 configured to protrude inward into the ice discharging space 290 may be coupled to the guide lever cover 240. Specifically, the one end of the rotating shaft 261 of the auger 260 configured to protrude inward into the ice discharging space 290 may be coupled to a shaft coupling hole 242 formed in the guide lever cover 240. A mounting member 19 may be used to firmly couple the one end of the rotating shaft 261 of the auger 260 configured to protrude inward into the ice discharging space 290 to the shaft coupling hole 242.

The guide lever 220 may rotate into the ice discharging space 290 until the guide lever cover 240 interferes with the guide lever 220. That is, the guide lever 220 may rotate into the ice discharging space 290 until the guide lever 220 comes into contact with the guide lever cover 240.

The guide lever cover 240 may be fixedly coupled to the ice bank 210 to cover the guide lever 220. Specifically, the guide lever cover 240 may be fixedly coupled to the opening forming wall 212 of the ice bank 210 by a fixing member. The fixing member may include a screw and the like, but as long as the fixing member fixedly couples the guide lever cover 240 to the ice bank 210, a kind thereof is not limited.

The guide lever cover 240 and the ice bank cover 250 may also be integrally formed.

Figure 6:
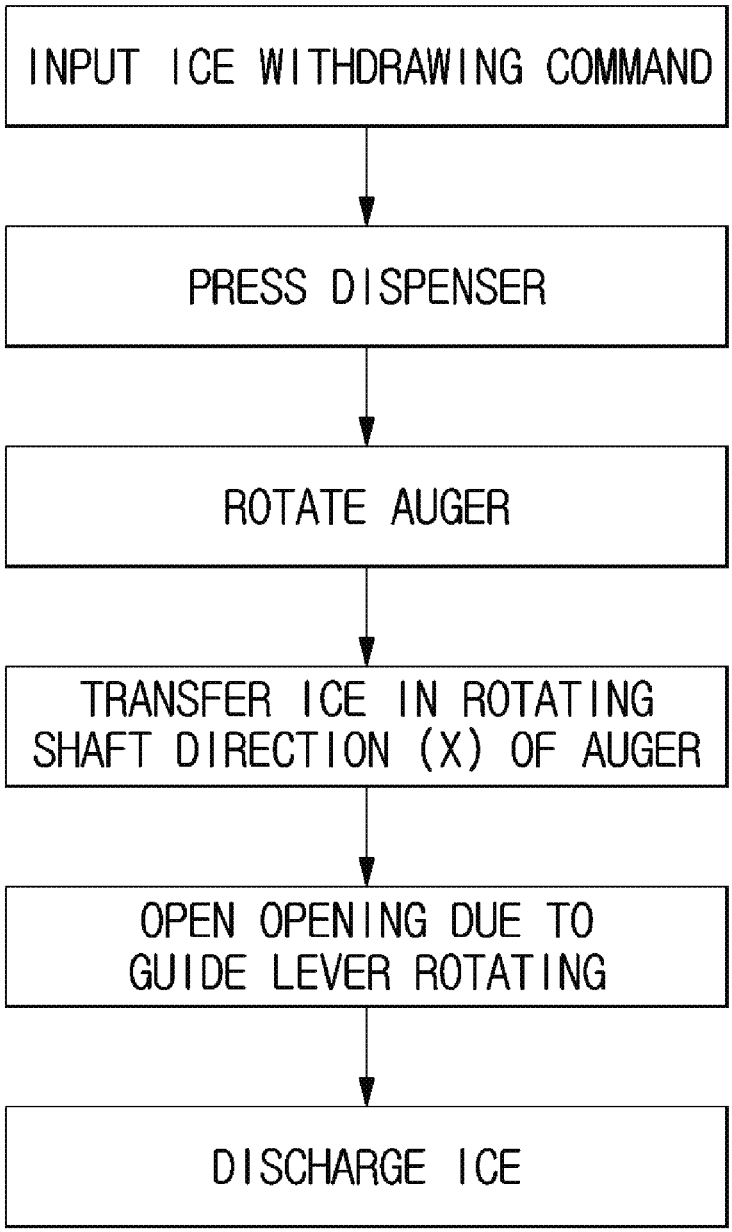
FIG. 6 is a block diagram for showing a process of withdrawing ice from the refrigerator according to one embodiment of the present disclosure.

FIG. 6 is a block diagram for showing a process of withdrawing ice from the refrigerator according to one embodiment of the present disclosure. Hereinafter, reference numerals which are not shown refer to FIGS. 1 to 5B.

A process of withdrawing ice will be described with reference to FIG. 6.

A user inputs an ice withdrawing command. As one example, the user may input the ice withdrawing command through a display (not shown) which may be provided at the refrigerator 1. The user may input the ice withdrawing command by selecting an ice withdrawal icon among the ice withdrawal icon and a water withdrawal icon displayed on the display. As another example, the user may also input the ice withdrawing command by pushing an ice withdrawal button (not shown) which may be provided at the refrigerator 1. A method through which a user inputs an ice withdrawing command is not limited thereto and may be variously changed.

The dispenser 37 is pressurized. Specifically, the operating lever 39 of the dispenser 37 is pressurized.

When a pressure signal of the dispenser 37 is transmitted to the controller (not shown), the auger motor 270 starts to operate. As the auger motor 270 operates, the auger 260 is rotated. The auger 260 may be rotated in one direction.

As the auger 260 is rotating, the ice stored in the ice bank 210 is transferred forward from the ice bank 210. That is, the rotation of the auger 260 acts as a driving force to transfer the ice stored in the ice bank 210 toward the opening 211 of the ice bank 210.

The guide lever 220 is pushed by the ice and opens the opening 211. Specifically, the guide lever 220 forcibly opens the opening 211 while being pushed by the ice being moved forward from the ice bank 210 in the rotating shaft direction X of the auger 260 and rotating toward the outside of the ice bank 210.

When the opening 211 is opened by the guide lever 220, the ice is discharged to the outside of the ice bucket 200 through the discharge hole 251.

The ice discharged to the outside of the ice bucket 200 is discharged to the outside of the refrigerator 1 through the dispenser 37. The discharge hole 251 of the ice bucket 200 may be provided to be in communication with an ice inlet (not shown) provided at the dispenser 37. Accordingly, the ice discharged through the discharge hole 251 of the ice bucket 200 is introduced into the ice inlet of the dispenser 37 and discharged through the chute 40 and the withdraw hole 38*a*.

Since the ice is no longer moved forward from the ice bank 210 when the auger 260 stops rotating, only the elastic force of the elastic member 230 is applied to the guide lever 220. Accordingly, the guide lever 220 closes the opening 211 again using a restoring force of the elastic member 230, which was contracted when the guide lever 220 opened the opening 211.

Figure 7A:
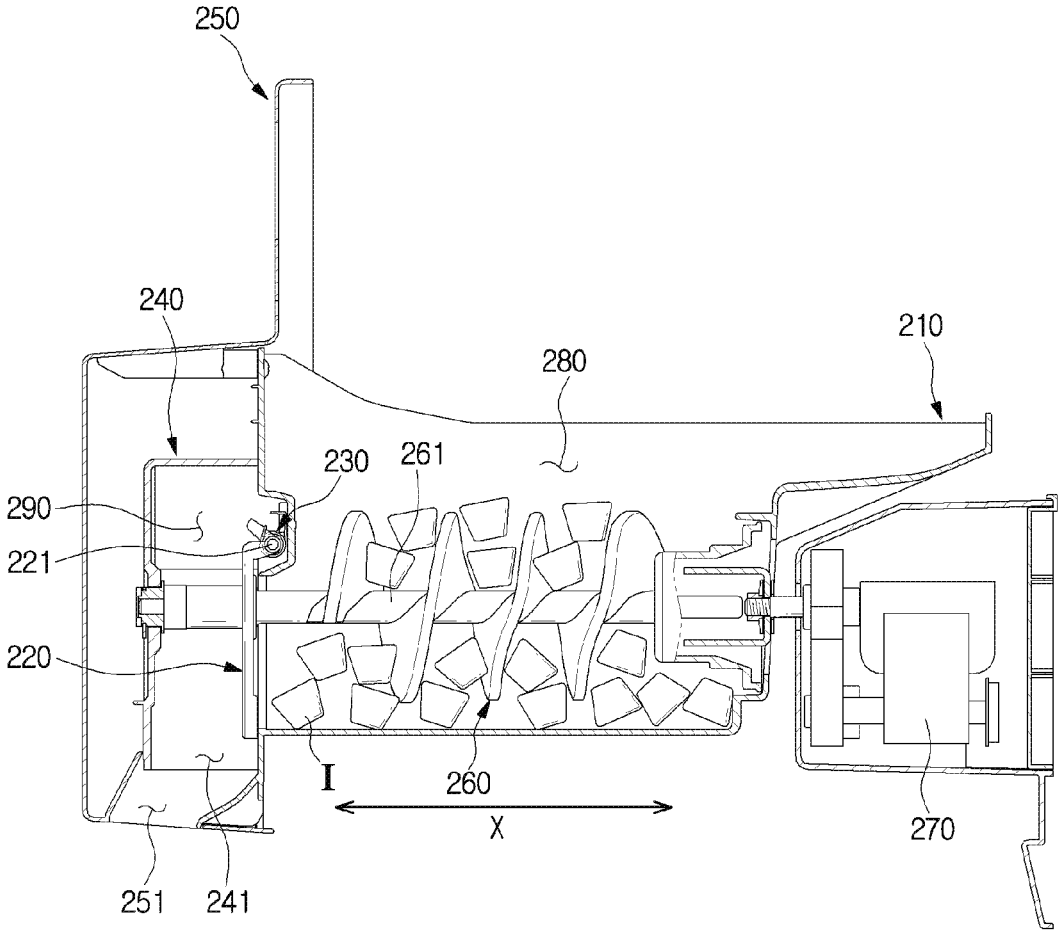
FIGS. 7A and 7B are cross-sectional views illustrating a process of discharging ice to the outside of the ice bucket of the refrigerator according to one embodiment of present disclosure.
Figure 7B:
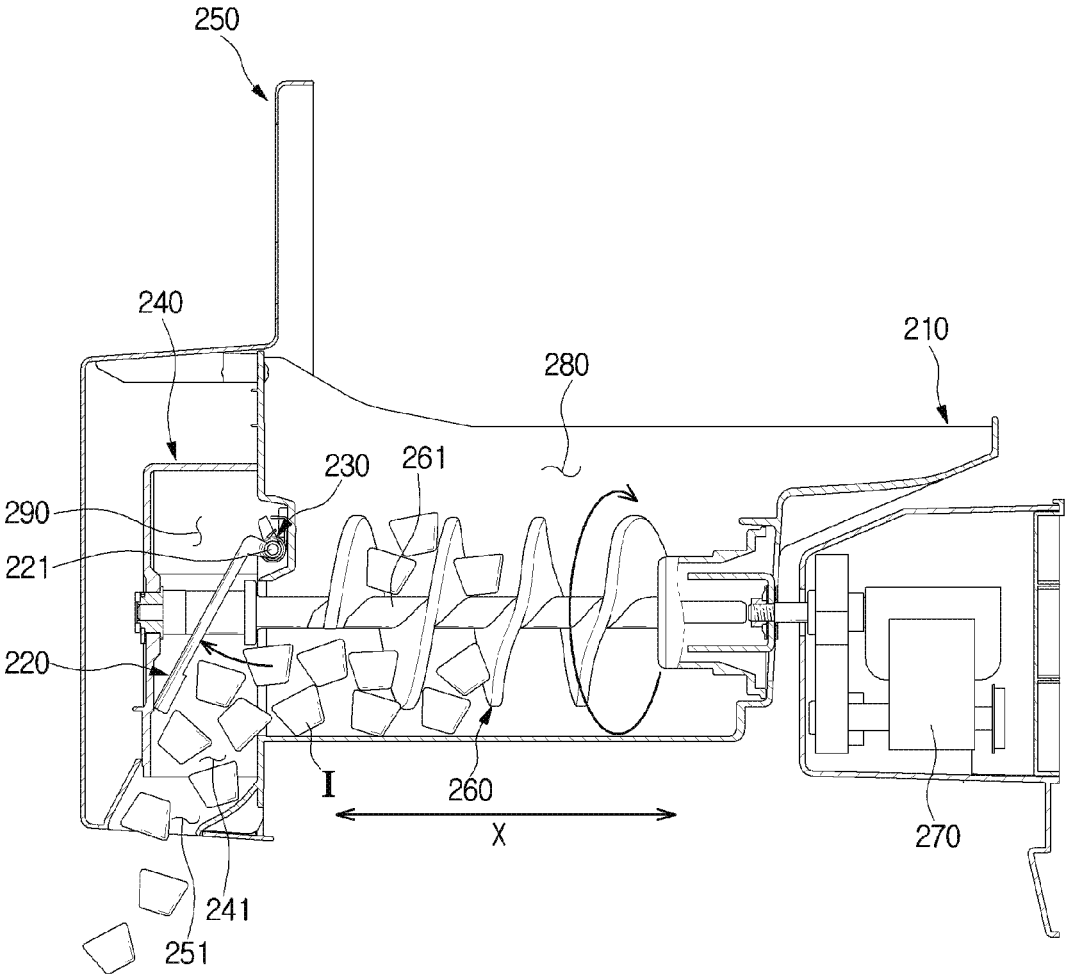

FIGS. 7A and 7B are cross-sectional views illustrating a process of discharging ice to the outside of the ice bucket of the refrigerator according to one embodiment of present disclosure. Hereinafter, reference numerals which are not shown refer to FIGS. 1 to 3.

As illustrated in FIG. 7A, when an ice withdrawing command is not input by a user, a state in which the opening 211 is closed by the guide lever 220 is maintained. This is to prevent ice accommodated in the ice bank 210 from being released to the outside due to an impact which may occur when the doors 30 and 31 are opened or closed. Since the auger motor 270 does not operate until the ice withdrawing command is input by the user, the auger 260 does not rotate and stays stationary. Accordingly, ice stored in the ice bank 210 is not moved in the rotating shaft direction X of the auger 260. At this time, only the elastic force of the elastic member 230 is applied to the guide lever 220.

As illustrated in FIG. 7B, when the ice withdrawing command is input by the user, the opening 211 is opened by the guide lever 220. When the ice withdrawing command is input by the user, the auger 260 is rotated by an operation of the auger motor 270. Accordingly, ice stored in the ice bank 210 is transferred forward from the ice bank 210 in the rotating shaft direction X of the auger 260. The guide lever 220 opens the opening 211 by being pushed by the ice being transferred forward from the ice bank 210. Specifically, when the ice being transferred forward from the ice bank 210 pushes the guide lever 220 in the rotating shaft direction X of the auger 260, the guide lever 220 rotates about the guide lever shaft 221 toward the outside of the ice bank 210. In other words, the guide lever 220 rotates about the guide lever shaft 221 toward the inside of the ice discharging space 290. At this time, the guide lever 220 may rotate in a range in which the guide lever cover 240 does not interfere with the guide lever 220.

Hereinafter, the process of withdrawing ice will be described based on an aspect of a force applied to the guide lever 220.

When the ice withdrawing command is input by the user, the elastic force of the elastic member 230 and a force (hereinafter, a driving force) of ice being pushed forward from the ice bank 210 in the rotating shaft direction X of the auger 260 are applied to the guide lever 220. Since the driving force due to the ice is greater than the elastic force due to the elastic member 230 when the ice withdrawing command is input by the user, the guide lever 220 rotates toward the outside of the ice bank 210, and the opening 211 is opened as a result.

Conversely, since only the elastic force due to the elastic member 230 is applied to the guide lever 220 when the ice withdrawing command is not input by the user, the opening 211 is closed by the guide lever 220.

Since the guide lever 220 according to one embodiment of the present disclosure may open or close the opening 211 using the elastic force of the elastic member 230 and a driving force of ice, a separate electric driving source is not needed. Accordingly, an energy reduction effect can be expected.

In addition, a structure of the ice-making device 100 can be simplified by using the guide lever 220 capable of opening or closing the opening 211 using the elastic force of the elastic member 230 and the driving force of ice without using an exit opening and closing device manufactured as a complex structure including an opening and closing member, a connecting rod, a solenoid driving device, and the like to open or close the opening 211.

In addition, since a noise problem that a user has to endure when an electric driving source such as a solenoid driving device is used can be solved, satisfaction of the user can be improved.

Although the refrigerator in which the ice-making device not having an ice-grinding function is applied has been mainly described, the guide lever 220 according to one embodiment of the present disclosure can be applied to an ice-making device having the ice-grinding function in addition to the ice-making device not having the ice-grinding device.

As is apparent from the above description, an opening of an ice bank can be opened or closed by a simple structure because a guide lever configured to rotate about a guide lever shaft is installed in the ice bank.

Since a guide lever can open an opening of an ice bank by being rotated due to a force of ice being pushed, a separate electric driving source for opening the opening of the ice bank is not necessary, and thus energy can be saved.

Since a guide lever can close an opening of an ice bank using an elastic force of an elastic member when an auger does not rotate, and can open the opening of the ice bank using a force of ice being pushed when the auger rotates, a noise problem which occurs when a solenoid driving device is used to open or close the opening of the ice bank can be eliminated.

Although a few embodiments of the present invention have been shown and described above, the invention is not limited to the aforementioned specific exemplary embodiments. Those skilled in the art may variously modify the invention without departing from the gist of the invention claimed in the appended claims.

What is claimed is:

1. A refrigerator comprising:

a main body; and an ice bucket provided to supply ice, wherein the ice bucket includes:

an ice bank provided with an ice storage space therein and an opening;

an auger including a rotating shaft, the auger rotatably disposed in the ice bank to rotate about the rotating shaft to transfer ice;

a guide lever rotatably installed in the ice bank on a guide lever shaft to open or close the opening, the guide lever pushable to open the opening while the auger rotates to transfer the ice in an axial direction of the rotating shaft and to push the guide lever with the ice being transferred; and an elastic member configured to apply an elastic force to rotate the guide lever so that the guide lever closes the opening when the auger is stationary, wherein the rotating shaft is included in the ice bucket to be perpendicular to the guide lever shaft so that an axis of rotation of the rotating shaft is perpendicular to an axis of rotation of the guide lever shaft, wherein the ice bucket further includes:

an ice moving path provided for moving ice being transferred by the auger through the ice storage space and an ice discharging space disposed adjacent to the ice storage space, an ice bank cover provided with the ice discharging space therein, and comprising a discharge hole through which the ice being transferred that is to pass through the opening is to be discharged to an outside of the ice bucket, and a guide lever cover disposed between the ice bank and the ice bank cover to define the ice discharging space, the guide lever cover including an opening hole corresponding to the discharge hole, and wherein the guide lever is rotatable toward an inside of the ice discharging space until the guide lever cover interferes with the guide lever.

2. The refrigerator of claim 1, wherein the guide lever is to open or close a part of the opening.

3. The refrigerator of claim 1, wherein the guide lever further includes:

a body to extend from the guide lever shaft, the body to open or close the opening without interfering with the rotating shaft when the guide lever is rotated.

4. The refrigerator of claim 3, wherein the body is to surround at least a part of the rotating shaft and is to be spaced apart from the rotating shaft of the auger.

5. The refrigerator of claim 1, wherein:

the ice storage space and the ice discharging space are disposed in the axial direction of the rotating shaft; and the guide lever is accommodated in the ice discharging space and rotatably provided in the ice bank.

6. The refrigerator of claim 1, wherein the rotating shaft is to pass through the opening so that a part of the rotating shaft protrudes into the ice discharging space.

7. The refrigerator of claim 1, wherein:

the rotating shaft is to pass through the opening so that one end of the rotating shaft protrudes into the ice discharging space; and the one end of the rotating shaft coupled to the guide lever cover.

8. The refrigerator of claim 1, wherein the guide lever cover and the ice bank cover are integrally formed.

9. A refrigerator comprising:

a main body; and an ice bucket provided in the main body and configured to dispense ice, wherein the ice bucket includes:

an ice bank provided with an ice storage space therein and an opening;

an auger including a rotating shaft, the auger rotatably disposed in the ice bank to rotate about the rotating shaft to transfer ice in an axial direction of the rotating shaft of the auger;

a guide lever rotatably installed at the ice bank to open or close the opening of the ice bank, and configured to rotate to open the opening based on a pushing force provided in the axial direction of the rotating shaft of the auger from the rotating shaft of the auger through the transferred ice during a rotation of the auger;

an elastic member configured to apply an elastic force to rotate the guide lever so that the guide lever closes the opening when the auger is stationary;

an ice moving path provided for moving ice being transferred by the auger through the ice storage space and an ice discharging space disposed adjacent to the ice storage space, an ice bank cover provided with the ice discharging space therein, and comprising a discharge hole through which the ice being transferred that is to pass through the opening is to be discharged to an outside of the ice bucket; and a guide lever cover disposed between the ice bank and the ice bank cover to define the ice discharging space, the guide lever cover including an opening hole corresponding to the discharge hole, wherein the guide lever is rotatable toward an inside of the ice discharging space until the guide lever cover interferes with the guide lever.

10. The refrigerator of claim 9, wherein the guide lever couples to the ice bank to be positioned above the opening and rotates about a guide lever shaft, wherein the guide lever shaft is to extend in a direction different from an axial direction of the rotating shaft.

11. The refrigerator of claim 9, wherein the elastic member includes a torsion spring.

* * * * *